US006196665B1

(12) United States Patent
Weeks

(10) Patent No.: US 6,196,665 B1
(45) Date of Patent: Mar. 6, 2001

(54) LATCH FOR AN INK CARTRIDGE

(75) Inventor: David E. Weeks, Willseyville, NY (US)

(73) Assignee: Transact Technologies, Inc., Wallingford, CT (US)

( * ) Notice: Subject to any disclaimer, the term of this patent is extended or adjusted under 35 U.S.C. 154(b) by 0 days.

(21) Appl. No.: 09/454,952

(22) Filed: Dec. 3, 1999

(51) Int. Cl.[7] ..... B41J 2/14
(52) U.S. Cl. ..... 347/49
(58) Field of Search ..... 347/49, 50, 138, 347/152, 170, 222, 245, 263

(56) References Cited

U.S. PATENT DOCUMENTS

| | | | | |
|---|---|---|---|---|
| 4,500,895 | * | 2/1985 | Buck et al. | 347/50 |
| 4,709,247 | | 11/1987 | Piatt et al. . | |
| 4,755,836 | | 7/1988 | Ta et al. . | |
| 5,049,904 | | 9/1991 | Nakamura et al. . | |
| 5,245,361 | * | 9/1993 | Kashimura et al. | 347/50 |
| 5,359,357 | | 10/1994 | Takagi et al. . | |
| 5,561,450 | | 10/1996 | Brewster, Jr. et al. . | |
| 5,579,039 | * | 11/1996 | Kurata et al. | 347/49 |
| 5,629,725 | | 5/1997 | Buican . | |
| 5,646,658 | | 7/1997 | Thiel et al. . | |
| 5,847,731 | * | 12/1998 | Kashimura et al. | 347/49 |
| 5,980,021 | * | 11/1999 | Nagoshi et al. | 347/49 |
| 6,065,826 | * | 5/2000 | Robinson et al. | 347/49 |

* cited by examiner

*Primary Examiner*—N. Le
*Assistant Examiner*—Judy Nguyen
(74) *Attorney, Agent, or Firm*—Wall Marjama & Bilinski

(57) ABSTRACT

Apparatus for reciprocally moving one or more ink cartridges through the printing station of an ink jet printer. A carriage having at least one open top compartment equipped with a latching mechanism which is arranged to urge the front face of the ink cartridge into contact with the front wall of the compartment. The latching mechanism includes a frame that is pivotally supported in the rear wall of the compartment so that it can move between a rearwardly canted position into an upright vertical position. A biasing member is pivotally supported in the frame and contains a pair of spaced apart ramps. A spring rotates the biasing member within the frame so that the ramp rides in biasing contact with the back of an ink cartridge being inserted into the compartment as the frame is rotated from the canted position into the upright position.

10 Claims, 5 Drawing Sheets

LATCH FOR AN INK CARTRIDGE

BACKGROUND OF THE INVENTION

This invention relates to apparatus for removably mounting one or more ink cartridges within a carriage for reciprocally moving the cartridge of a small ink jet printer through the printing station of a machine.

In particular, this invention relates to a latching mechanism for removably securing one or more ink cartridges in the carriage of a small point of sale type printer. Many of the devices for securing an ink cartridge in a carriage involves lever and spring mechanisms that are relatively large and complex devices. As a consequence, these devices consume a good deal of valuable space and leave little room for the user to operate the mechanism during insertion and removal of the cartridge. It should be further noted that many of these prior art devices are arranged so that they bear directly upon the back wall of the cartridge when the cartridge is latched within the carrier. The cartridge is typically constructed of a thin material such as plastic and the holding force of the latching device can deform the cartridge forcing ink from the nozzles. This, in turn, produces unwanted dirt problems within the printer which, in extreme cases, requires the machine to be taken out of service for cleaning.

By the same token, if the latching mechanism does not hold the cartridge securely within the carrier, there is a high probability that the electrical connector located upon the front face of the cartridge will not make positive contact with the input terminals located on the opposing front wall of the carrier. When this occurs, the printer will produce a faulty or unintelligible printout.

As disclosed in U.S. Pat. No. 4,709,247, some latching devices require specially configured ink cartridges to insure proper engagement and operation of the latching mechanism. The cost of the ink cartridge is therefore substantially higher than the less complex cartridges presently in the market and therefore, reliability is generally lessened due to the close tolerances between parts.

SUMMARY OF THE INVENTION

It is therefore a primary object of this invention to improve apparatus for reciprocally moving one or more ink cartridges through the printing station of a small ink jet printer.

It is a further object of the present invention to reduce the size of a carriage required to reciprocally move one or more ink cartridges through the printing station of a small ink jet printer.

A still further object of the present invention is to provide for easy insertion and removal of an ink cartridge from an ink cartridge carrier.

Another object of the present invention is to provide for more positive registration of an ink cartridge in an ink cartridge carriage.

Yet another object of the present invention is to positively register an ink cartridge within a carriage without deforming the ink cartridge.

These and other objects of the present invention are attained by apparatus for reciprocally moving one or more ink cartridges through the printing station of a small ink jet printer. The apparatus includes a carriage containing an open top compartment for removably containing an ink cartridge. The ink cartridge rests upon a raised pad mounted in the floor of the compartment and a latching mechanism urges the front wall of the cartridge into registration with the front wall of the compartment. The latching mechanism includes a frame that is rotatably supported in the rear wall of the compartment. A biasing member is pivotally supported in the frame and contains a pair of spaced apart ramps that are adapted to contact the back of an ink cartridge that is inserted into the compartment immediately behind the corner where the back wall of the cartridge joins the side walls. The ramps are contoured so that they ride in rolling contact against the back of the cartridge as the frame is raised from an initial rearwardly canted position to an upright vertical position. When the frame is placed in the upright position, the flat section on each ramp snaps over into vertical alignment with the back wall of the cartridge thereby urging the front of the cartridge into positive registration with the front wall of the compartment.

BRIEF DESCRIPTION OF THE DRAWING

For a better understanding of the these and other objects of the present invention, reference should be made to the following detailed description of a preferred mode of practicing the invention, read in connection with the accompanying drawings, in which.

DETAILED DESCRIPTION OF THE INVENTION

Figure 1:
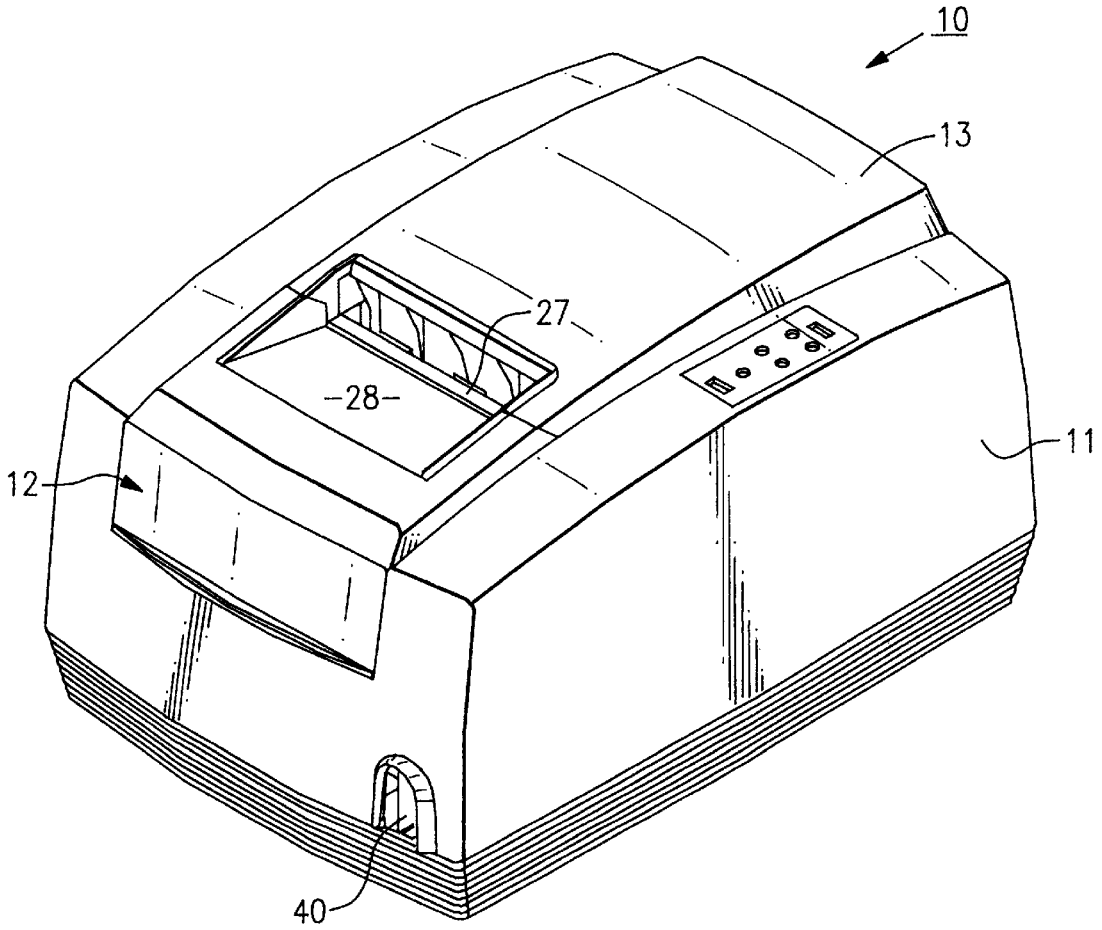
FIG. 1 is a perspective view of a printer embodying the teachings of the present invention.
Figure 2:
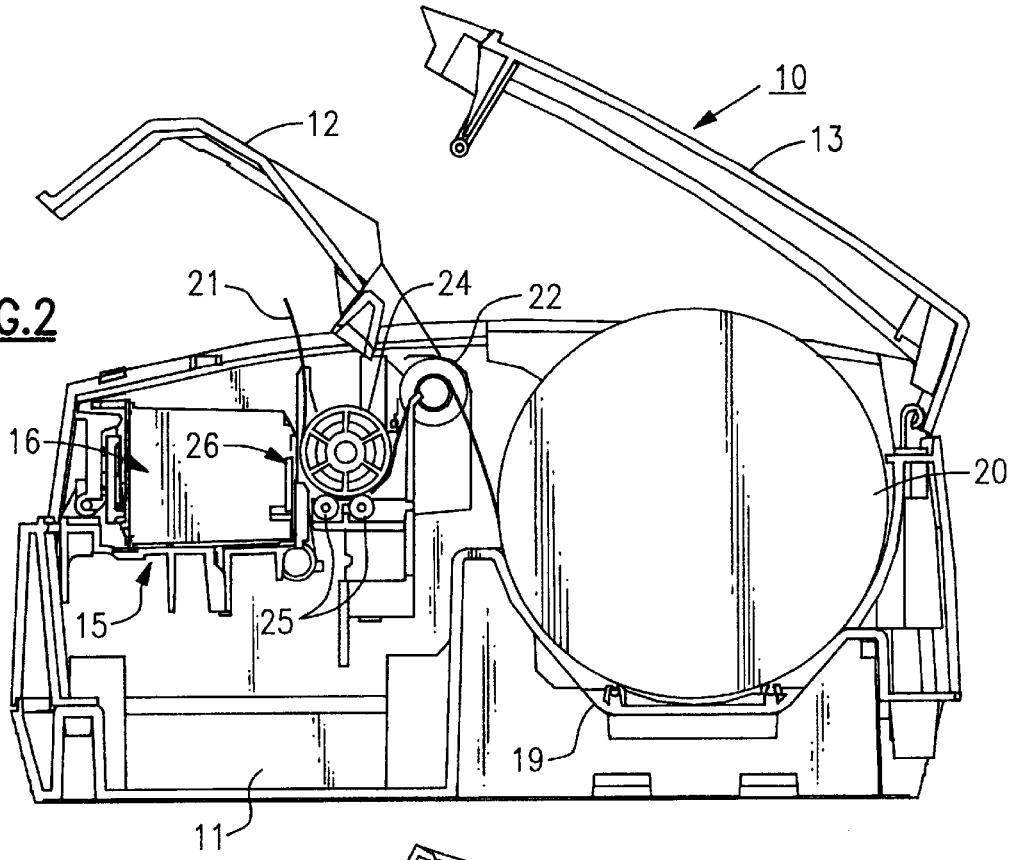
FIG. 2 is a side elevation in section of the printer shown in FIG. 1.
Figure 3:
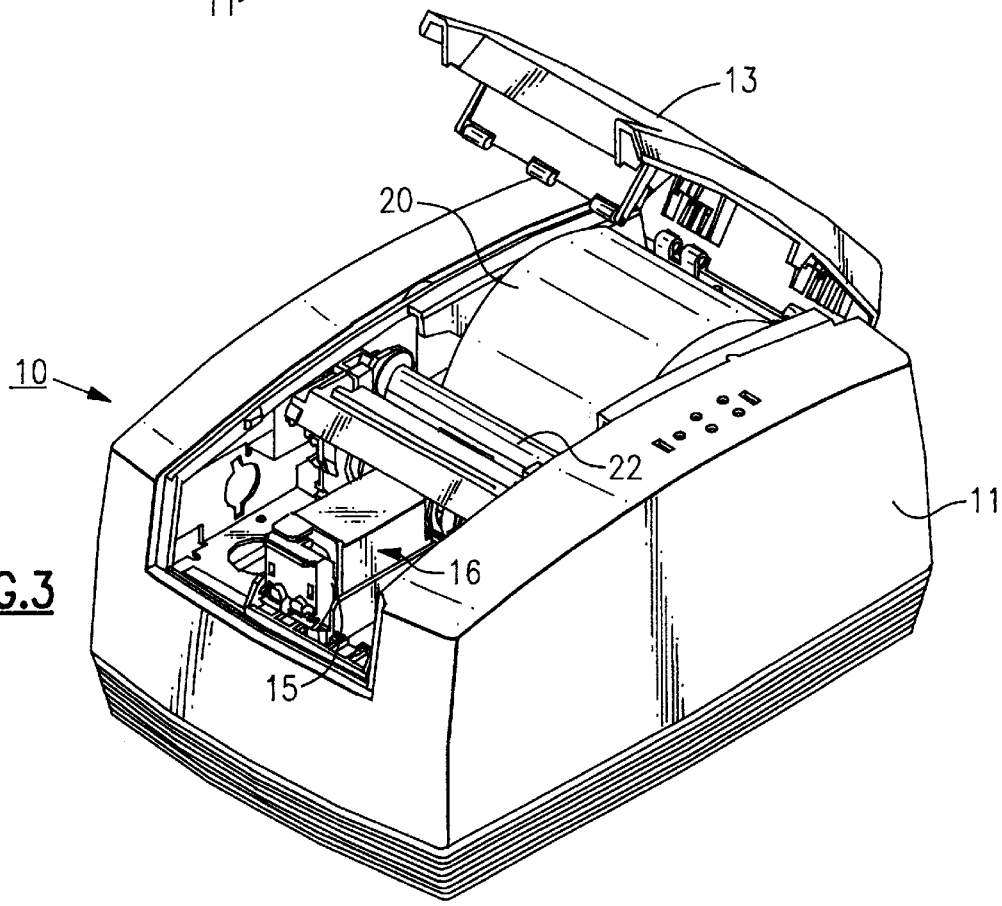
FIG. 3 is a front perspective view of the printer with the front cover removed and the rear cover raised.
Figure 4:
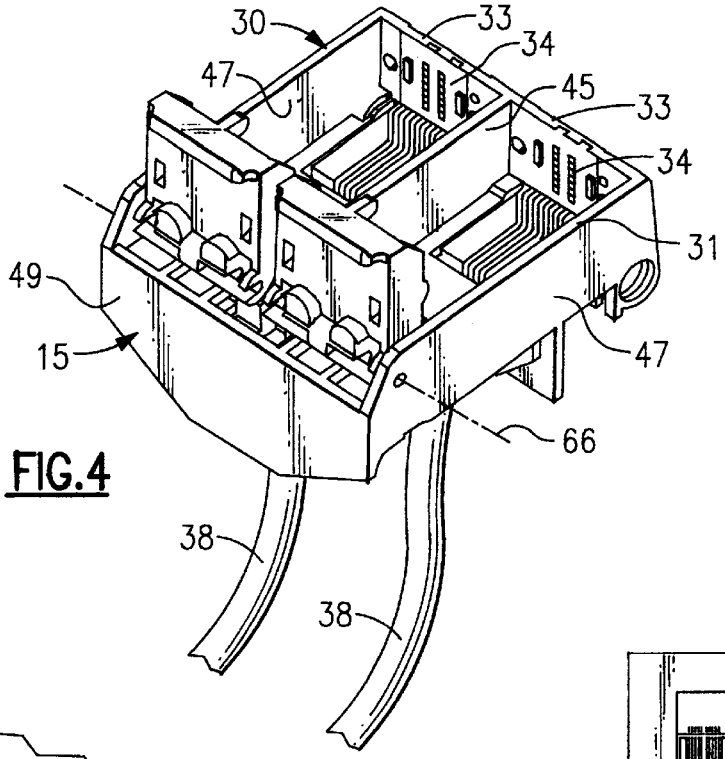
FIG. 4 is an enlarged partial perspective view of the ink cartridge carriage employed in the practice of the present invention.
Figure 7:
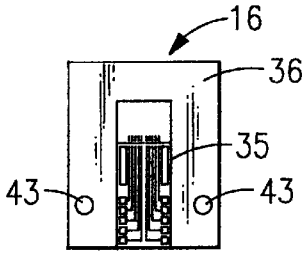
FIG. 7 is a front view of the ink cartridge illustrated in FIG. 6.

Referring initially to FIGS. 1–3, there is illustrated a relatively small point of sale ink jet printer capable of accepting a data input from a computer or the like and providing a printed receipt. This type of printer is typically employed in a cramped working environment and, through necessity, the size of the printer must be relatively compact. Accordingly, the available space within the unit is limited. The printer includes a housing generally referenced 10 that contains a base 11 upon which is hinged a front cover 12 and rear cover 13. The front cover 12, when raised as illustrated in FIG. 2, provides ready access to the ink cartridge carriage 15 that reciprocally moves one or more cartridges 16 horizontally through a printing station 26. The rear cover, when raised as illustrated in FIG. 2, similarly provides ready access to a paper supply bin 19 that is adapted to hold a supply roll 20 of paper upon which receipt data is printed. The leading section 21 of the paper roll is fed over an idler roll 22 and beneath a drive roller 24 where it is engaged by a pair of pinch rolls 25 which holds the paper in friction driving contact against the drive roller. Under the influence of the drive roller, the paper is advanced through the printing station 26 and through an opening 27 in the front cover into a read out station 28 (FIG. 1). The apparatus for driving the carriage and rotating the drive roller are well known in the art and will not be explained in greater detail herein.

Figure 8:
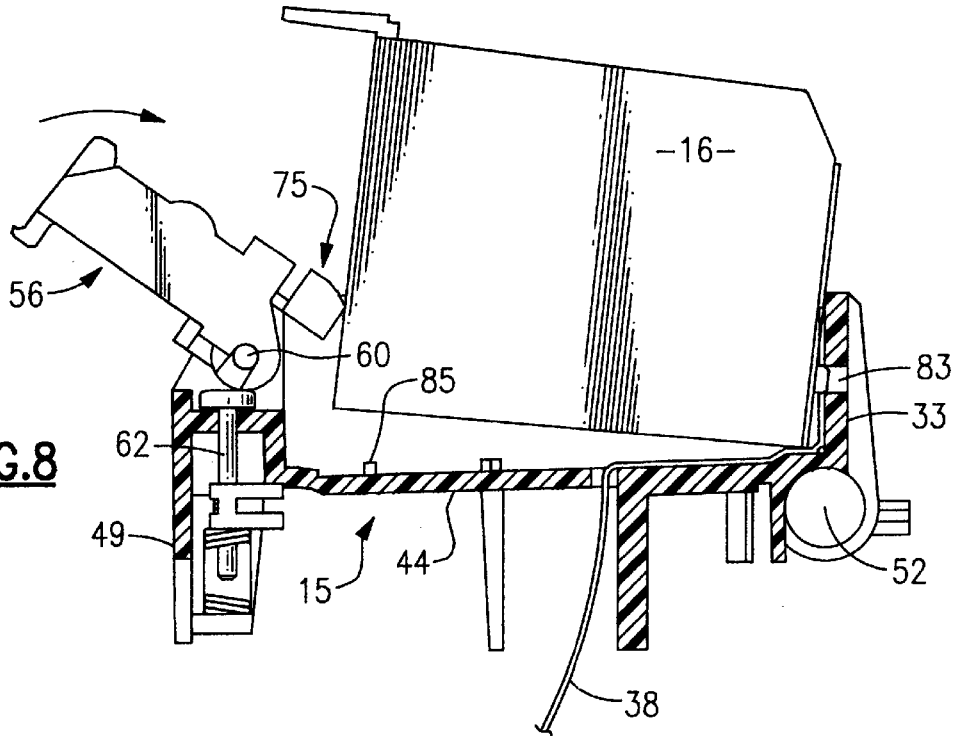
FIG. 8 is an enlarged side view in partial section of the printer carriage showing an ink cartridge partially inserted into the carriage and in initial contact with the carriage latching mechanism.
Figure 9:
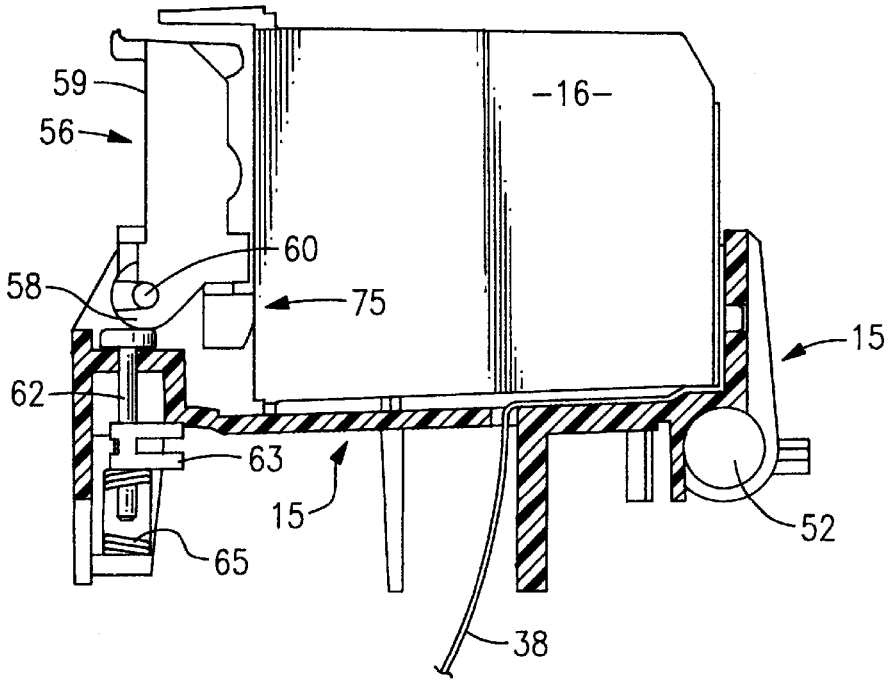
FIG. 9 is a view similar to FIG. 8 showing the cartridge latched into the carriage.
Figure 10:
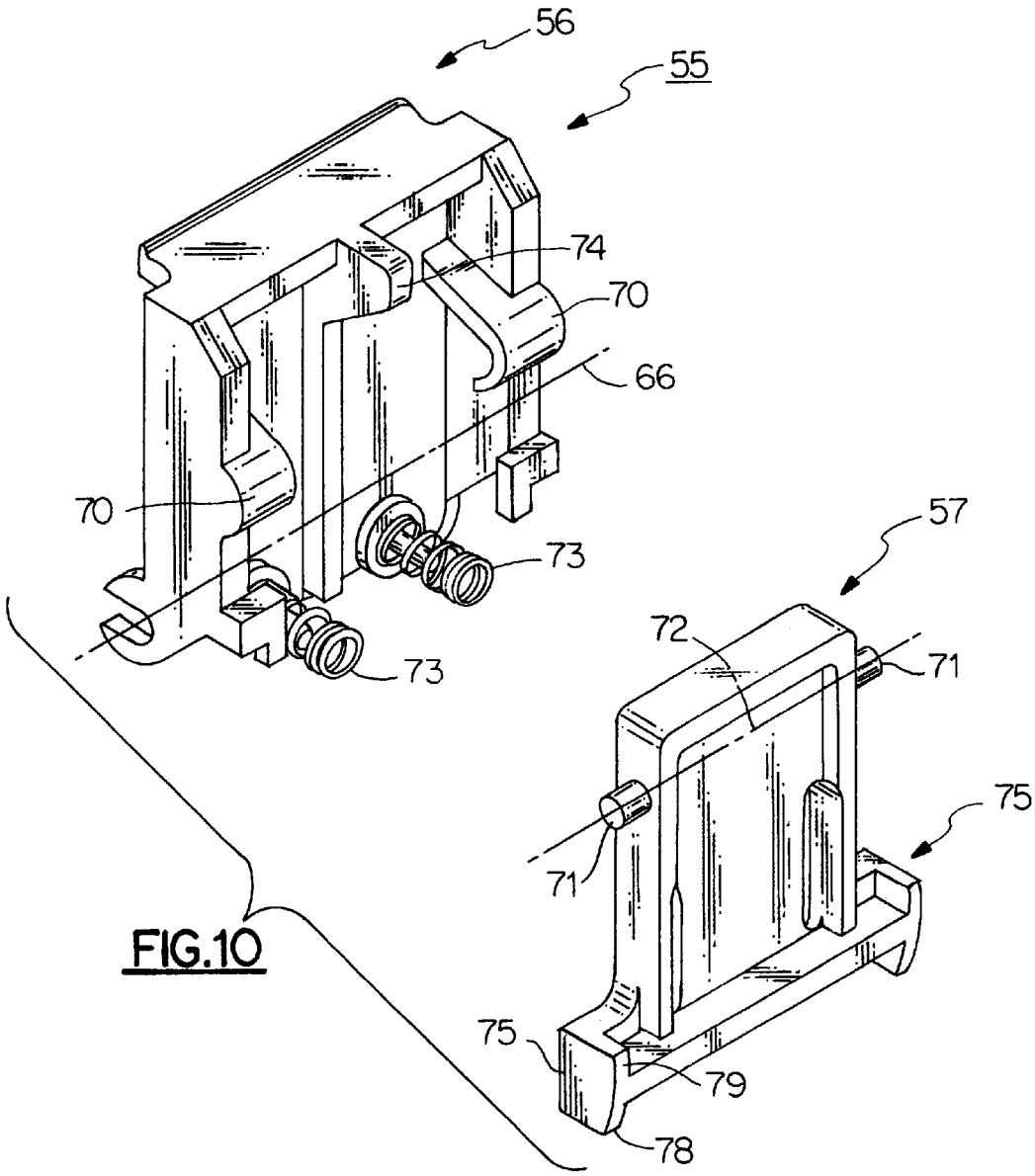
FIG. 10 is an enlarged exploded view showing the construction of the latch mechanism employed by the present invention.

Turning now to FIGS. 4–8 there is further illustrated in greater detail carriage 15 which contains a pair of side-by-side compartments 30 and 31, each of which is adapted to hold an ink cartridge 16. In practice, each cartridge contains ink of different color than its neighbor so that the printer can produce a two color image in response to the input data provided by a control computer or microprocessor (not shown). The front wall 33 of each cartridge compartment contains a set of electrical input terminals 34 that are arranged to make contact with a terminal board 35 contained on the front face 36 (FIG. 7) of the ink cartridge 16 when the cartridge is latched in place within the carriage as shown in FIG. 9. Input leads 38—38 are attached to the underside of the carriage and provide a data link between the input terminals and a computer 40 (FIG. 1). Each cartridge contains a series of nozzles located in the front face of the cartridge that lay down an image pattern in response to the data input to the cartridge. Here again, the operation of the ink cartridge is well known in the art and need not be explained in any greater detail. Each cartridge is equipped with a pair of forwardly protruding lugs 43—43 which, as will be explained in detail below, serve to help index and register the cartridge within the associated carriage compartment.

The lugs are located at the side edges of the cartridge front wall so that each lug is supported by both the front wall and one side wall of the cartridge housing.

The carriage 15 contains a horizontally disposed floor 44 upon which the two compartments 30 and 31 reside. Each compartment shares a common side wall 45 with its neighbor and an opposed side wall 47. The back of each compartment is closed by common elongated back wall 49. The side walls of the compartments are spaced apart to provide a close running fit with a cartridge that is slidably received within the compartment through the open top thereof.

Figure 5:
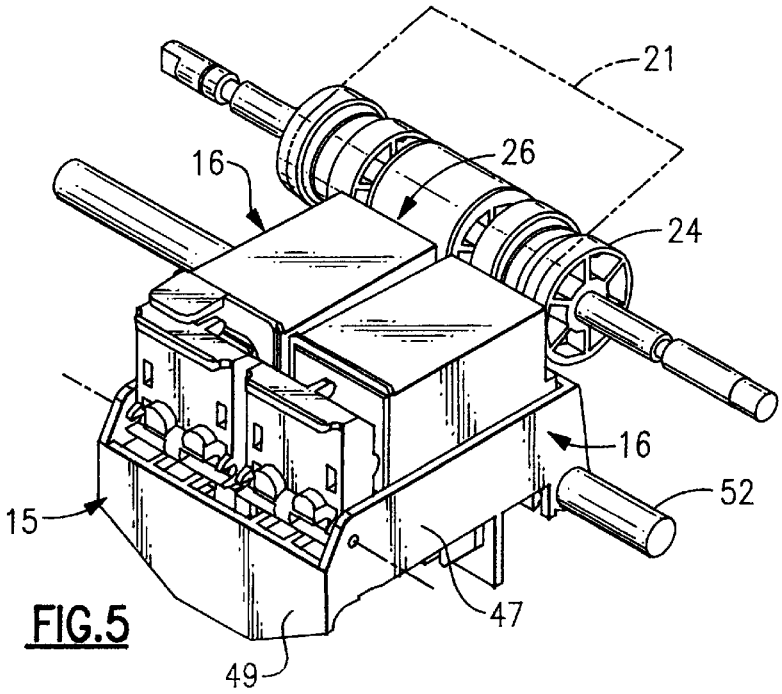
FIG. 5 is a perspective view similar to that shown in FIG. 4 showing a pair of ink cartridges mounted in the carriage and further showing the machine platen mounted in front of the said carriage.

As best illustrated in FIG. 5, the carriage is arranged to ride upon a rail 52 and is reciprocated through the printing station 26. As noted above, a paper substrate 21 is advanced through the printing station via the drive roller 24 where a two color image can be printed on the paper.

A latching mechanism 55 is mounted on the rear wall of the carriage behind each compartment. The mechanism includes a frame 56 and a locking member 57 that is pivotally mounted in the frame. The frame includes a hinge 58 located in the lower part of its back wall 59 that is adapted to pivotally engage a horizontally disposed hinge pin 60 that is supported in assembly between end walls 47. The frame is permitted to rotate about a horizontal axis 66 upon the hinge pin between a rearwardly canted position as illustrated in FIG. 8 and a vertical or upright position as illustrated in FIG. 9. A plunger 62 is slidably mounted in the carriage within a bracket 63 and is biased upwardly into contact with the hinge by spring 65 to apply a slight friction holding force on the frame whereby the frame will remain in whatever position it is placed.

Two opposing bearing caps 70 are mounted in the side walls of the frame that are adapted to receive therein trunnions 71 that protrude from the side walls of the locking member 57. Accordingly, in assembly, the locking emmber can pivot within the frame about a horizontal axis 72 that is parallel with the pivot axis 66 of the frame. A pair of compression springs 73—73 are suppored withint the frame and act upon the back of the locking member to rotate the locking member in a counter clockwise direction. The counter clockwise movement of the locking member is arrested by a stop 74 located in the top of the frame.

A pair of ramps 75—75 are supported in the lower section of the locking member and are adapted to ride in contact along the vertical edges 77 (FIG. 6) of a cartridge rear wall as the cartridge is being loaded as shown in FIG. 8 into one of the carriage compartments. Each ramp includes an arcuate shaped lower section 78 which transitions into a flat vertically disposed upper section 79. To insert a cartridge into a compartment, the lugs situated in the front part of the cartridge are placed at an angle into locating holes 83 formed in the front wall of the carriage compartment and the back wall is brought into contact with the arcuate lower section of each ramp as shown in FIG. 8. The cartridge is then forced downwardly toward the floor of the carriage which causes the frame to rotate in a clockwise direction while at the same time rotating the locking member back within the frame against the biasing action of the spring. The cartridge continues down until the bottom wall comes to rest against a raised rib 85 situated on top of the compartment floor. At this time, the front wall of the cartridge is vertically aligned with the front wall of the compartment and the cartridge connectors are in registered contact with input terminals 34 mounted on the front wall of the compartment. As the ramps ride down the rear wall of the cartridge, each ramp crosses over the transition line between the two ramp sections and the upper planar section snaps over into flat contact against the rear wall of the cartridge, thus holding the cartridge securely against the front wall of the compartment. To remove the cartridge from the compartment, the back portion of the cartridge is simply grasped and then pivoted upwardly about its front edge. This, in turn, causes the latching mechanism to rotate rearwardly unlatching the cartridge.

Figure 6:
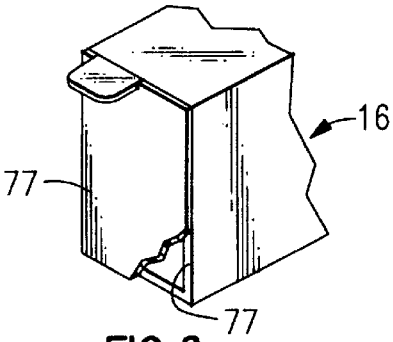
FIG. 6 is a rear perspective view of an ink cartridge with portions broken away to further show the construction of the cartridge.

As shown in FIG. 6, the ink cartridges are typically fabricated of a thin walled plastic material. Placing pressure upon the center portion of any of the walls can cause the wall to deform and thus force ink from the nozzle ports. By arranging the ramps so that they ride in contact against the edge regions 77 of the back wall causes most of the spring force applied to the ramps to be resisted in compression by the two side walls of the cartridge thereby preventing the cartridge from deforming to a point where ink is forced from the nozzles.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. Apparatus for transporting an ink cartridge having a bottom wall, a pair of opposed sidewalls and opposed front and rear walls over a reciprocal path of travel within an inkjet printer, said apparatus including:

a carriage containing, an open top compartment containing, a horizontally disposed floor and a vertically disposed front wall extending upwardly from the floor, a raised pad mounted on the top surface of said floor whereby the front wall and the bottom wall of the ink cartridge can be registered within the compartment against the front wall of the carriage and said raised pad, a latching means that is mounted in the back of said compartment for urging the front wall of said ink cartridge into biasing contact against the front wall of said carriage, said latching means further including a frame mounted for rotation about a first horizontal axis in the back of said compartment, said first axis of rotation being parallel with the front wall of said compartment; and a locking member pivotally mounted for rotation in said frame about a second horizontal axis of rotation that is in parallel alignment with said first axis of rotation, a pair of spaced apart vertically extended ramps mounted in said locking member, and spring means acting between the frame and the locking member for urging the ramps into contact with the back wall of said cartridge positioned in said compartment when said frame is rotated from a first rearwardly canted position into a second upright position.

2. The apparatus of claim 1 wherein said ramps are located a given distance beneath the second axis of rotation.

3. The apparatus of claim 2 wherein the spacing between said ramps is equal to the spacing between the side walls of said ink cartridge and said ramps being positioned to contact the rear wall of the cartridge immediately behind said side walls.

4. The apparatus of claim 3 wherein each ramp includes a first lower arcuate section that is integral with a second upper planar section whereby the arcuate section of each ramp rides in rolling contact with the cartridge as the frame is rotated from said first position to said second position and the planar section of each ramp snaps into contact against the cartridge when the frame is placed in said second position.

5. The apparatus of claim 1 that further includes indexing means for registering the front wall of the cartridge with the front wall of the compartment.

6. The apparatus of claim 5 wherein said indexing means includes a pair of spaced apart forwardly extended lugs that are slidably received in holes located in the front wall of said compartment.

7. The apparatus of claim 1 wherein said frame further includes a hinge mounted in the lower section thereof that is pinned in a rear wall of said compartment so that the frame pivots about a pin.

8. The apparatus of claim 7 that further includes a friction pad mounted in said rear wall of the compartment acting upon said hinge to apply a friction force to said hinge.

9. The apparatus of claim 1 wherein said carriage includes a plurality of compartments.

10. The apparatus of claim 9 wherein each adjacent compartment shares a common side wall with its next adjacent neighbor.

* * * * *